US007121922B2

(12) United States Patent
van Brug

(10) Patent No.: US 7,121,922 B2
(45) Date of Patent: Oct. 17, 2006

(54) METHOD AND APPARATUS FOR POLISHING A WORKPIECE SURFACE

(75) Inventor: Hedser van Brug, Den Haag (NL)

(73) Assignee: Nederlandse Organisatie voor toegepast-natuurwetenschappelijk Onderzoek TNO, VK Delft (NL)

( * ) Notice: Subject to any disclaimer, the term of this patent is extended or adjusted under 35 U.S.C. 154(b) by 0 days.

(21) Appl. No.: 10/489,702

(22) PCT Filed: Sep. 13, 2002

(86) PCT No.: PCT/NL02/00590

§ 371 (c)(1),
(2), (4) Date: Sep. 8, 2004

(87) PCT Pub. No.: WO03/026846

PCT Pub. Date: Apr. 3, 2003

(65) Prior Publication Data

US 2005/0009447 A1 Jan. 13, 2005

(30) Foreign Application Priority Data

Sep. 13, 2001 (NL) ..... 1018943

(51) Int. Cl.
*B24B 49/00* (2006.01)
*B24B 1/00* (2006.01)

(52) U.S. Cl. ..... 451/6; 451/5; 451/7; 451/8; 451/9; 451/10; 451/41; 451/286; 451/287; 451/288

(58) Field of Classification Search ..... 451/6, 451/7, 8, 9, 10, 41, 286, 287, 288, 5
See application file for complete search history.

(56) References Cited

U.S. PATENT DOCUMENTS 4,594,003 A * 6/1986 Sommargren ..... 356/489
5,067,282 A 11/1991 Netzel
5,822,066 A * 10/1998 Jeong et al. ..... 356/521
6,032,377 A 3/2000 Ichikawa et al.
6,301,009 B1 * 10/2001 Tinker ..... 356/511

FOREIGN PATENT DOCUMENTS

DE 198 55 455 6/1999

* cited by examiner

*Primary Examiner*—Lee D. Wilson
*Assistant Examiner*—Shantese L. McDonald
(74) *Attorney, Agent, or Firm*—Young & Thompson

(57) ABSTRACT

The invention relates to a method for machining a workpiece surface, wherein an area to be machined of the workpiece surface is machined under the influence of a polishing operation and wherein, during the machining, the displacement of the area to be machined relative to a reference area rigidly coupled to the workpiece surface is monitored by means of interferometry. The invention further relates to a machining apparatus, comprising a polishing tool and a measuring tool, while the measuring tool comprises an interferometer. Preferably, the polishing tool comprises a fluid jet polishing device.

22 Claims, 8 Drawing Sheets

METHOD AND APPARATUS FOR POLISHING A WORKPIECE SURFACE

BACKGROUND OF THE INVENTION

The invention relates to a method for machining a workpiece surface, in which an area to be machined of the workpiece surface is machined under the influence of a polishing operation.

Such a method is generally known and is often used for polishing surfaces of optical components, such as refractive optical components, for instance lenses or windowpanes from glass, quartz or BK7, and reflective optical components such as mirrors, from metal or ceramics. Known methods for polishing, in addition to polishing with a grinding template and grinding paste, are, generally, material-removing techniques such as SPDT (single point diamond turning), CCP (computer controlled polishing), MRF (magneto-rheologic finishing), FJP (fluid jet polishing) and EEM (Elastic Emission Machining), IBF (Ion Beam Figuring) and IBP (Ion Beam Polishing).

A problem which occurs with the known operations is that it is relatively time-consuming to manufacture a workpiece whose surface has a very great form accuracy. This is chiefly caused by the fact that it is often not possible to measure the form of the workpiece during machining. In particular when manufacturing aspherical optical surfaces, the polishing operation in an iterative process needs, each time, to be interrupted for measuring the workpiece in a separate measuring operation. Often, the measuring operation then takes place in a separate measuring environment, so that, each time, the workpiece has to be clamped again.

The invention contemplates a method for machining a workpiece surface, in particular an optical workpiece surface, with which, while maintaining the above-mentioned advantages, the drawbacks mentioned can be obviated.

SUMMARY OF THE INVENTION

To that end, the invention provides a method for machining a workpiece surface, with which, under the influence of a polishing operation, an area to be machined of the workpiece surface is machined and, during machining, the displacement of the area to be machined relative to a reference area rigidly coupled to the workpiece surface is monitored by following over time a phase difference between a measuring beam and a reference beam and by converting it into a displacement relative to a reference area, while, by choosing the change of the phase difference between measurements to be in the interval $(-\pi, \pi)$, the total displacement can be obtained by addition. By monitoring during machining, through interferometry, the displacement of the area to be machined relative to a reference area rigidly coupled to the workpiece surface, the form change of the workpiece can be monitored during machining and, without frequent clamping and unclamping of the workpiece for a separate measuring operation, a very great form accuracy of the surface can be achieved. The rigid coupling between the area to be machined and the reference area then enables reliable measurements with interferometry, while monitoring only the relative movement of an area to be machined relative to a reference area simplifies the use of interferometry.

Advantageously, the reference area forms part of the workpiece surface. However, the reference area can also form part of a different body, rigidly coupled to the workpiece surface, such as a clamping device.

The displacement of the area to be machined can then be monitored by following one point of the workpiece surface, but can also be monitored by following several points of the area to be machined. Naturally, also parts of the workpiece surface situated outside the area to be machined can be scanned so as to monitor, for instance, the deformation of the entire workpiece. In an advantageous embodiment of the invention, the workpiece is arranged, during machining, in a stationary manner and the area to be machined is a relatively small part of the workpiece surface which, during machining, moves substantially transversely to the workpiece surface. Such an operation can be carried out very well by locally machining a stationarily disposed workpiece with the aid of fluid jet polishing and by reflecting a beam of laser light, having a width which is at least as great as the width of the area to be machined corresponding to the fluid jet incident on the workpiece surface, via the area to be machined onto a light sensitive pixel array such as a CCD, having a width corresponding to that of the reflected beam. Naturally, it is also possible that during machining, the area to be machined moves over the workpiece surface, as in a rotating or milling operation. In such a case, with for instance each rotation of the workpiece, the movement of the area to be machined relative to the reference area can be measured.

Advantageously, when using the interferometry of two coherent light beams, a first light beam is reflected on the area to be machined and a second light beam is reflected on the reference area.

However, within the context of the invention, it is also possible that the reference area forms part of the measuring area. In addition thereto, or as an alternative, it is advantageous in this connection for the beam to have a width such that the beam partially enters on the area to be machined and a reference area adjoining the area to be machined, so that a displacement of the area to be machined results in a varying phase within the measuring beam. Such a phase variation can, for instance, be detected by means of shifting the reflected beam or by creating a zero-phase beam from a reflected partial beam.

Advantageously, after reflection, the beams are combined and the phase difference between the interfering beams is measured and from the consecutive measurement, the change of the phase difference between the interfering beams of the consecutive measurements is determined and, on the basis thereof, the displacement of the area to be machined relative to the reference area is determined.

Highly advantageously, the time interval between consecutive measurements is chosen such, that the change of the phase difference between the interfering beams is between $-\pi$ and $\pi$. In this manner, the change of the phase difference between the beams can be followed as function of the time without so-called $2\pi$ ambiguities, so that the displacement of the area to be machined can be directly derived from the phase difference. By adding up the displacements of the area to be machined, determined between two consecutive measurements, the total relative displacement of the area to be machined relative to the reference area can be accurately monitored.

The polishing operation is preferably a material-removing operation, such as SPDT, CCP, MRF, FJP, IBF and IBP.

Advantageously, for the purpose of the interferometry, prior to measurement, the workpiece surface is cleared, at least near the area to be machined, of contaminations which can cause false reflections, such as chips or polishing liquid.

Advantageously, the workpiece surface, at least near the area to be machined, is then blown clean with the said of compressed air.

Advantageously, when the workpiece is transparent, at least the first light beam can be reflected through the workpiece on the side of the area to be machined adjoining the workpiece. What can thus be achieved is not only that the monitoring of the displacement of the workpiece surface is not hindered by the polishing tools, and can therefore take place in a continuous manner, but also that, in a simple manner, the components related with the interferometry are screened off from the area where the machining takes place, by means of a screen contiguous to the workpiece surface near the area to be machined.

Advantageously, at least one of the beams is then guided to the side of the workpiece surface adjoining the workpiece via a fluid adjoining the workpiece surface and having a refractive index which is substantially equal to that of the workpiece material. What can be achieved with the aid of such a matching fluid is that the beam enters substantially straight from the fluid into the workpiece. Preferably, the first light beam enters on the side of the area to be machined adjoining the workpiece at an angle $\alpha$ which is greater than the critical angle for total internal reflection. In this manner, the amount of light reflected on the area to be machined can be maximal and light passing through the workpiece surface can be prevented from being reflected back and causing interference.

The invention further relates to a machining apparatus, comprising a polishing tool and a measuring tool, while the measuring tool comprises an interferometer. The polishing tool can then be substantially form-retaining, such as a diamond tool for SPDT or polishing pad for CCP, but can also comprise a fluid, as in MRF and FJP.

Further advantageous embodiments of the invention are represented in the subclaims.

It is noted that, within the context of this application, a polishing operation is at least understood to mean a surface operation removing or not removing material, the initial condition of the surface being such that light can be reflected on the surface in a manner suitable for interferometry.

Further, it is noted that, within this context, (continuously) monitoring the displacement of the area to be machined during the machining is not only understood to include monitoring the displacement while the workpiece surface is being machined, but also the (intermittent) monitoring of the displacement between periods of machining of the surface, while the workpiece remains clamped on the machine.

It is further noted that, within this context, light beams coherent relative to each other are understood to mean that with respect to their wave front, there is a known, fixed relation between the light beams before reflection on the area to be machined or reference area and that in the phase as function of the time, no jumps occur. Such light beams, coherent relative to each other, can be obtained in a simple manner by splitting a single coherent light beam through amplitude or wave front splitting.

In a further preferred embodiment, the method comprises the steps of:

irradiating the measuring area with a light beam, while reflection or transmission of the beam occurs;

splitting the transmitted or reflected beam;

varying the phase of the split beams relative to each other such that the differential phase is kept within the range of 2 pi;

combining the split beams with each other and observing a fringe pattern indicating a differential phase between the split beams;

calculating an optical path length difference from the differential phase; and relating the optical path length difference to the contour variations of the object.

The above-mentioned method has as an advantage that the phase information which is contained in a reflected dr transmitted beam can be withdrawn therefrom without a separate auxiliary optic being required for generating a reference beam at the location of the measuring area. This means, that by analysing the fringe patterns of a recombined beam, the phase change of the beam as a result of a contour variation can be determined in a low-vibration environment which is hardly troubled by interfering external factors resulting from machining steps or other influences at the location of the measuring area, because these factors are equally incorporated in both beams and are eliminated upon phase subtraction. As a result, environmental disturbances have less influence on the measurements. Thus, in a simpler manner, measurements of higher quality can be carried out.

The technique utilizes the temporal phase unwrapping technique (TPU), as described, for example, in H. van Brug, "Temporal phase unwrapping and its application in shearography systems", Appl. Opt. 37 (28), pp. 6701–6706, 1998. This technique enables keeping the phase image resolved over time by carrying out incremental phase measurements which, each time, correspond to a phase change which is in the range of 2 pi, and by adding these up over time.

In a preferred embodiment, the phase of the split beams is varied by carrying out a relative movement of the beam and the measuring area such that the form of the measuring area changes. Through a changing form of the measuring area, the phase image in the beam changes. By detecting the phase change according to the method of the invention, by means of a scanning movement, for instance by fixing the object and having the beam carry out a scanning movement and/or, conversely, by fixing the light beam and carrying out a small displacement of the object, a phase change in the beam can be realized which can register, each time, from a zero position, the contour variations relative to that zero position. By keeping, each time, via TPU, the phase resolved in time, by carrying out the scan, the geometry of the object can be analysed over an arbitrarily large scanning surface.

In a further embodiment, the phase can be varied by placing an optical phase filter in one of the split beams for generating a predetermined phase plane. This phase filter can be a pin hole the size of the diffraction spot, so that the phase plane is a zero front. Naturally, this zero front can be modified by a hologram or by a different phase optic, for obtaining a fringe pattern having an acceptable resolution which corresponds to a particular contour. For instance, in an embodiment a zero front can be formed with a phase optic, which, by means of the fringe patterns can be adjusted for exactly zero so as to detect a desired, predetermined contour. The pin hole allows a small fraction of the beam through on an optical axis. As a result, a pointed light source is simulated having a virtually flat phase front. Through the phase filter therefore, a zero phase beam is delivered, carrying in itself exactly the disturbances and path length differences which are introduced by the optic. These disturbances are eliminated upon interference with the reflection or transmission beam, so that, accurately, a phase disturbance can be detected which is caused by optical path length variations resulting from a contour variation.

In a preferred embodiment, the beam has a diameter such that at least two positions varying in height in a measuring area are illuminated; the method comprising the further step of: shifting the measuring beam relative to itself along the connecting line between the above-mentioned positions so that a differential phase between the shifted beams lies within a range of 2 pi; and, through integration of the differential phase, calculating an optical path length difference related to the contour variation of the object. It is noted that the shifting technique per se is known to the skilled person as "shearing".

In an advantageous embodiment of this application of shearing, the method comprises the step of rotating a split beam by means of a rotating mirror; projecting the split beams on a lens, which beams, as a result of the rotation, run at an angle relative to each other; and observing a fringe pattern in a focal plane of the lens as a result of a shift of the beams which corresponds to the angle displacement of the rotating mirror. By carrying out the rotation of the mirror in a controlled manner, a fringe pattern is formed which corresponds to a first order derivative of the phase shift. By examining the phase angle, this first order can be resolved to a phase image which, with reference to above-mentioned embodiments, can be related to a contour variation of the object.

Preferably, the measuring beam is then a parallel light beam having a relatively small diameter, while the measuring area has a dimension which is smaller than the diameter of the measuring beam.

In an alternative embodiment, the reflected measuring beam can be a diffuse light beam. In one variant, the measuring beam can be a homogenous, parallel light beam, while the measuring surface is provided with a mat layer, such that the reflected beam is a diffuse light beam. In a different variant, the measuring beam can be reflected on a smooth surface, while the measuring beam is a diffuse light beam. What is meant by a diffuse beam is a beam with a virtually random distribution of directions within a predetermined range of directions. Such a range can have one central main direction, in particular a direction towards the observation optic. The use of such diffuse light sources is known to the skilled person as a speckle technique. In the framework of the invention, this technique offers the advantage that relatively larger surfaces with relatively large form variations can be analysed. In particular, by incremental measuring of the phase, an image is obtained in which the random distribution has disappeared, because the phase difference image, as is the case with a normal, homogenous beam, is exclusively related to the phase variation resulting from the contour variation.

The invention further relates to an apparatus for measuring a contour variation of a measuring area on an object. The apparatus according to the invention comprises a light source for providing a light beam for irradiating a measuring area; a holder for positioning the object relative to the light source; a beam splitting member for splitting the transmitted or reflected beam; a phase influencing member for setting a phase difference between the split beams; a beam combining member for combining the split beams; an observation member for observing a fringe pattern indicating a differential phase between the split beams; and a processor for calculating an optic path length difference from the differential phase and for relating the optical path length difference to the contour variation of the object.

BRIEF DESCRIPTION OF THE DRAWINGS

The invention will now be further elucidated with reference to an exemplary embodiment represented in a drawing. In the drawing.

It is noted that the Figures are only schematic representations of a preferred embodiment of the invention. In the Figures, identical or corresponding parts are indicated with the same reference numerals.

DESCRIPTION OF THE PREFERRED EMBODIMENTS

Although, in the following example, the polishing operation is carried out with the aid of a fluid jet polishing device, it will be clear to the skilled person that the invention can be carried out analogously in combination with a different material removing or non-material removing polishing operation.

The technique of fluid jet polishing is generally known and described, inter alia, in Dutch patent application 1007589 in the name of Nederlandse Organisatie voor Toegepast Natuurwetenschappelijk Onderzoek-TNO of Delft. The interferometrical technique described in this exemplary embodiment is known to the skilled person as TPU (Temporal Phase Unwrapping).

Figure 1:
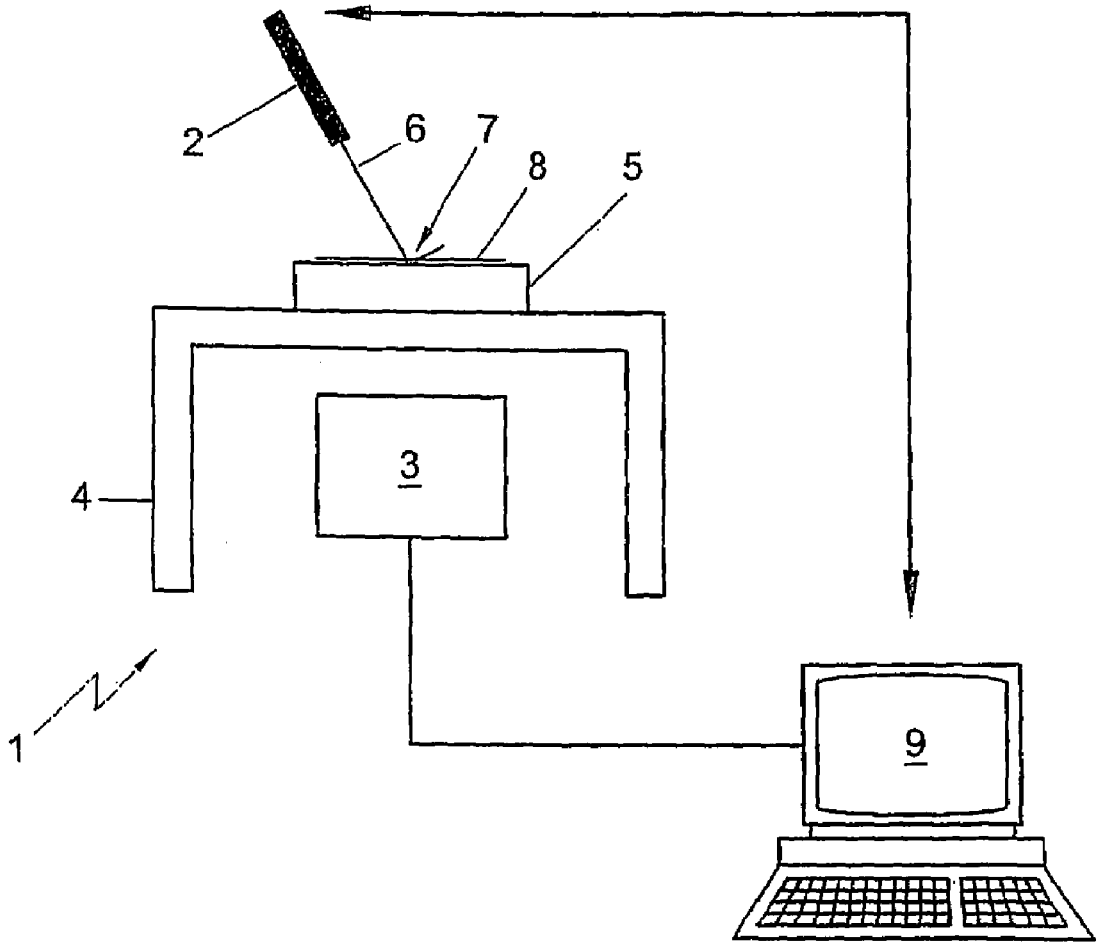
FIG. 1 shows a schematic perspective view of a machining apparatus according to the invention.
Figure 2:
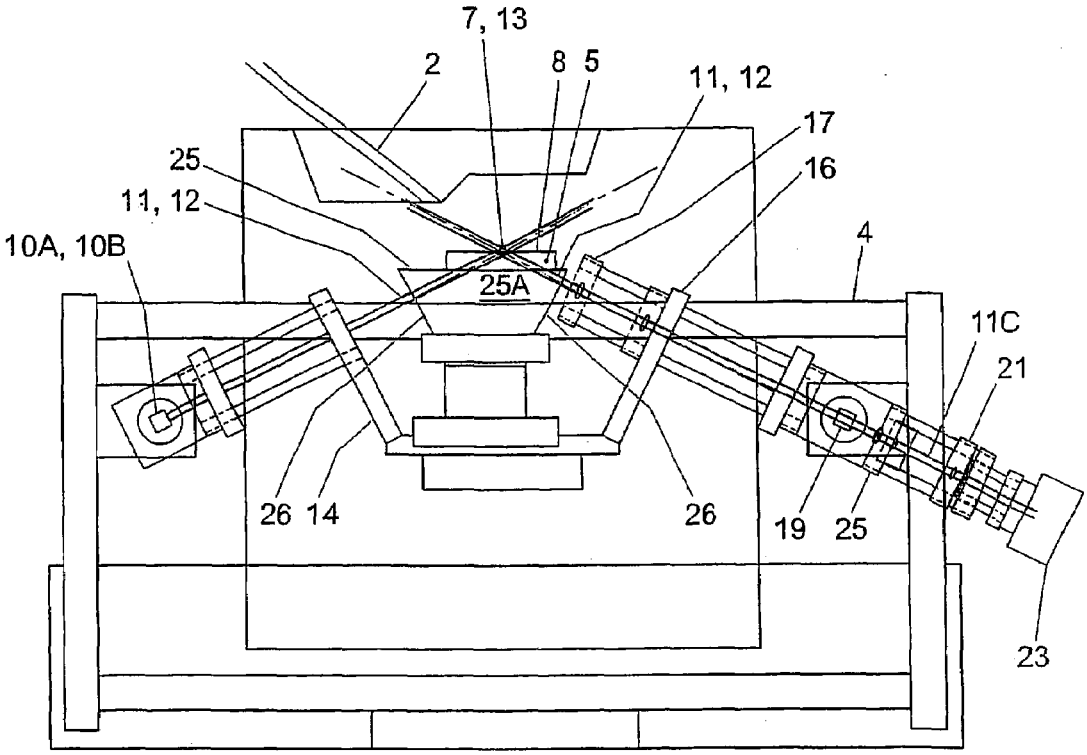
FIG. 2 shows a schematic side view of the workpiece table of FIG. 1.
Figure 3:
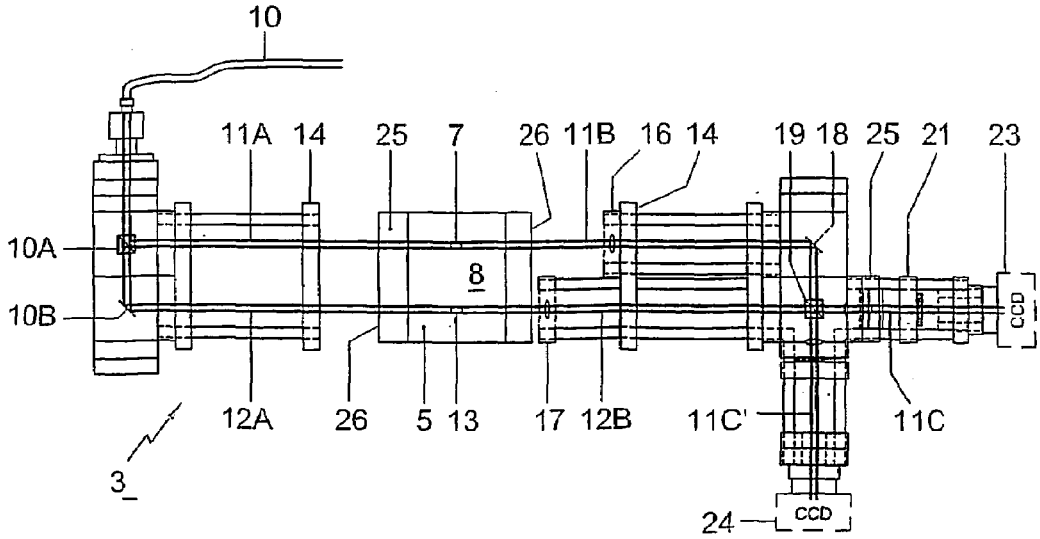
FIG. 3 shows a schematic bottom view of the workpiece table of FIG. 2.
Figure 4:
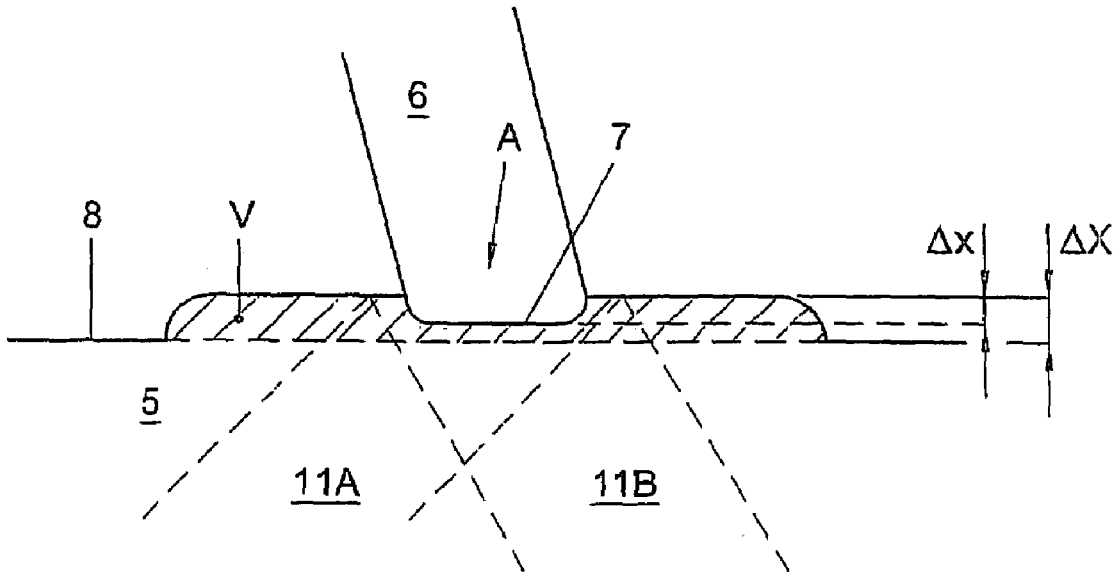
FIG. 4 shows a schematic cross section of a workpiece with an area to be machined.

With reference to FIGS. 1–3, a machining apparatus 1 is shown having a polishing tool designed as a fluid jet polishing device 2, and a measuring tool, designed as a laser interferometer 3. The machining apparatus 1 further comprises a workpiece table 4 on which a workpiece 5 of BK7 is clamped which can be machined with the aid of a jet of polishing liquid 6 leaving a nozzle of the fluid jet polishing device 2. The polishing fluid comprises, for instance, a slurry of 90 volume percent water and 10 volume percent of silicon carbide particles, each with a diameter of approximately 20 μm, which, via a spout nozzle with a cylindrical diameter of approximately 1 millimeter and a length of approximately 15 millimetres is spouted, at a pressure of approximately 5 bar, from a distance of approximately 10 cm at an acute angle onto the work piece 5, so that an elliptical area to be machined 7 is formed on the workpiece surface 8. The workpiece table 4 and the fluid jet device 2 are disposed so as to be movable relative to each other with the aid of a table and/or nozzle control mechanism (not shown) which is numerically controlled by a central processing unit 9, so that the area to be machined 7 can be displaced over the workpiece surface 8. Further, the central processing unit 9 is coupled to the laser interferometer 3.

The laser interferometer 3 comprises a laser source (not represented in the Figure) whose light beam is guided via a light guide 10 to a splitting cube 10A where the laser beam is split into two mutually coherent light beams, i.e. a first beam 11 which is reflected as measuring beam on the area to be machined 7 of the workpiece surface, and a second light beam 12 which is reflected as reference beam via a mirror 10B onto a reference area on the workpiece surface 8. The splitting cube 10A and the mirror 10B then form the means for giving off the first beam 11 and the second beam 12, respectively. As the workpiece is designed from rigid material (BK7), the area to be machined 7 is rigidly coupled to the reference area 13.

The components of the laser interferometer 3 are rigidly coupled to a clamping device 14 in which the workpiece 5 is rigidly fixed. The means 10A for giving off the measuring beam 11 can be arranged so as to be translatable and/or rotatable relative to the clamping device 14, so that the area to be machined 7 can be followed with the measuring beam 11 when it is displaced over the workpiece surface 8. For clarity's sake, this is not shown in the Figure. The laser interferometer 3 further comprises two focussing lenses 16, 17 for focussing the reflected measuring beam 11 and the reflected reference beam 12.

Further, in the path of the reflected measuring beam 11B, a half lambda retardation plate is included for rotating the polarisation direction of the reflected light of the measuring beam 11B through 90° relative to the light in the reflected reference beam 12B. Further, in the path of the reflected measuring beam 11B, a mirror 18 is arranged with which the reflected measuring beam 11B can be guided to a combining element 19 in which the split beams are combined.

From the combining cube 19 issue two combined light beams 11C, 11C' coherent relative to each other, which, via a polarizer 21, 22, each fall on the pixel array of a CCD-chip 23, 24. Before reaching the polarizer 21, the first combined light beam 11C passes a quarter lambda retardation plate 25 which retards the first combined light beam a quarter wave length relative to the second combined light beam, so that in the central processing unit 9 the image signals given off by the CCDs 23, 24, after, for instance, software-wise mirroring of one of the images, can be directly subtracted from each other, for determining the change of the phase difference between the interfering beams of consecutive measurements.

The reading frequency of the CCDs is then chosen such that the change of the phase difference between the interfering beams between consecutive measurements is, each time, between $-\pi$ and $\pi$, i.e. not including the values $\pi$ and $-\pi$.

The clamping device 14 is provided with a fluid container 25 for containing a transparent fluid 25A, the refractive index of which being equal to the refractive index of the material of the workpiece 5, so that on the boundary surface between the workpiece surface and the adjoining fluid, the light beams 12*a*, 12*b*, 13*a*, 13*b* run substantially straight. The workpiece 5 is then clamped in the clamping device 14 such that at the underside, the workpiece adjoins the fluid 25. As is represented in FIG. 2, the walls 26 of the fluid container 25 are provided with windows for guiding the light beams 12*a*, 12*b*, 13*a*, 13*b* therethrough. Relative to the normal, the walls 26 are arranged on the workpiece table 4 at a slight inclination, so that a light beam can enter relatively easily on the workpiece surface 8 of a workpiece 5 clamped in the clamping device 14 at the location of the area to be machined, at an incident angle $\alpha$ relative to the normal which is greater than the critical angle for total internal reflection.

The clamping device can be provided with a screen (not represented in the Figure) for cooperation with the workpiece surface 8 such that, during use, the screen screens off the interferometer 8 from an area where the machining takes place.

The polishing operation can be carried out by entering into the central processing device 9 a differential geometry between a geometry, laid down for instance in a CAD-model, to be compared to a real geometry determined on a measuring bank of the workpiece 5. On the basis of the differential geometry, a number of machining volumes V can be defined which, consecutively, with the aid of the jet polishing means 6, are machined for removal. With the aid of the interferometer 3, by means of reflection on the side of the area to be machined proximal to the inside of the workpiece, the displacement of the area to be machined can be monitored in the machining direction, i.e. substantially transversely to the area to be machined itself, by following over time the phase difference between the measuring beam 11 and the reference beam 12 resulting from the change in the path lengths travelled by the beams, and by converting them into a displacement. By choosing the change of the phase difference between measurements in the interval $(-\pi, \pi)$, the total displacement can be unequivocally obtained by addition.

When the displacement $\Delta x$ of the area to be machined 7 as a result of the polishing operation substantially corresponds to the displacement $\Delta X$ required for the decrease of the machining volume V, the jet of polishing agent 6 can be interrupted and a following area to be machined 7 can be machined. The displacement $\Delta X$ required for correction of the differential geometry is then equal to the local distance in starting direction A of machining between the workpiece surface of the measured geometry and the surface of the desired geometry.

Further, to verify the surface condition of the area to be machined 7, the intensity of a laser beam reflected on the area to be machined 7 can be measured with a laser roughness meter, so that an image can be formed of the roughness and damages possibly present below the workpiece surface 8. This technique is known per se as iTIRM. In this technique, an increase of the intensity of the reflected light shows a decrease of the roughness of the surface.

Such a roughness measurement can be carried out with the aid of the measuring beam 11 and/or the reference beam 12, but can also be carried out with the aid of a beam from a separate laser roughness meter with intensity meter, with or without support of the beams 11, 12 of the interferometer.

It is noted that in this exemplary embodiment, the measuring beam 11 and the reference beam 12 are reflected on the side of the workpiece surface 5 proximal to the workpiece, i.e. the inside surface. However, it is also very possible to have the beams 11, 12 reflect on the outer surface, i.e. the side of the workpiece surface 5 remote from the workpiece. To prevent the presence of contaminations on the workpiece surface 5 which can disturb the reflection, such as a film of polishing agent and loose fragments of workpiece material, the machining apparatus 1 can be provided with an air spray (not shown) for blowing the workpiece surface clean at least near the area to be machined before the measurement.

Figure 5:
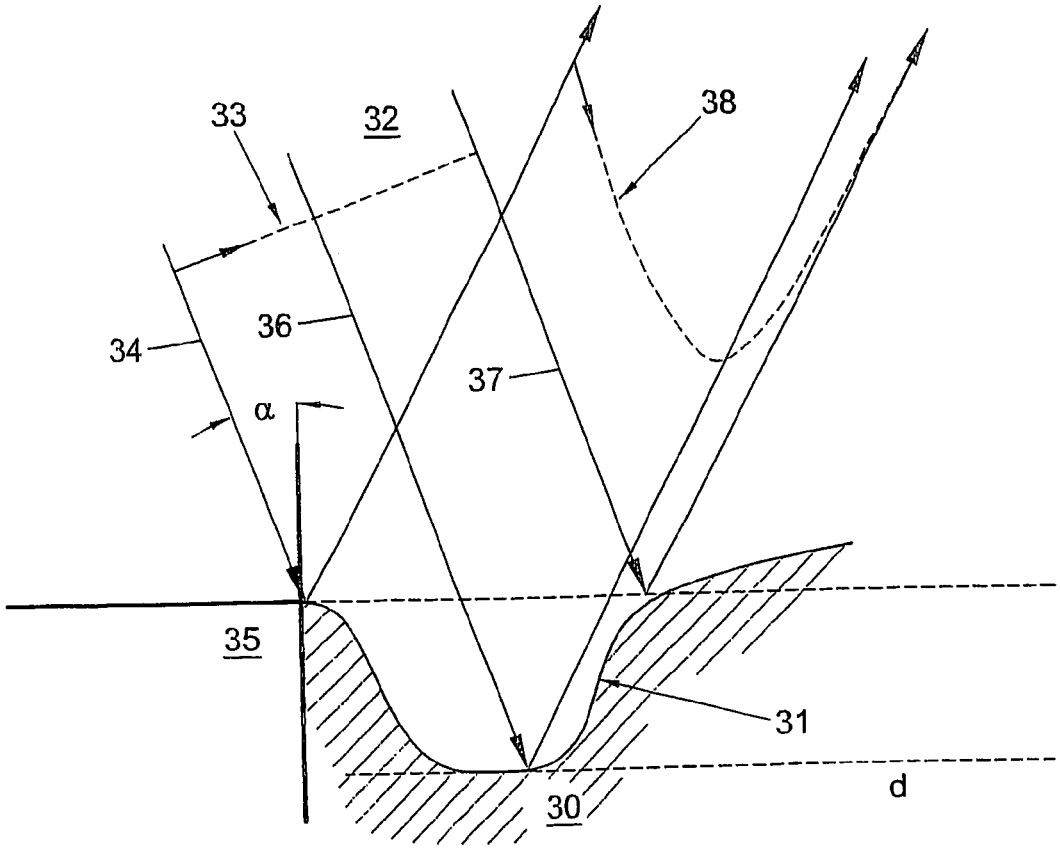
FIG. 5 shows a schematic set-up of a measuring beam scanning a contour variation.

With reference to FIG. 5, a basic set-up is now given of an object, such as, for instance, a reflective object 30 as an optical element, such as a lens, having a particular contour 31 which is measured with the aid of a scanning beam 32. Preferably, the scanning beam 32 is a coherent light beam, which, for reflection on the object 30, has a fixed phase front 33, for convenience's sake considered to be flat. It will appear, for that matter, that in certain cases as will be described with reference to FIG. 11, also for a non-flat phase front, the contour of the surface can be reduced from the phase image of the beam. In FIG. 5, with a first light beam 34, a light path of a beam is represented which reflects on a point of the object located at a first height. In the Figure, this height is represented by the zero height in a coordinate system 35 depicted in bold lines. Further, with a second light beam 36, a light path of a beam is represented which reflects on a point of the object located at a second height, at a distance d from the first point. Finally, for completeness's sake, a third light path 37 of a beam is represented, which, again, reflects on a position located at the zero height. From FIG. 5 it is clear that the different light beams which, in beam 32, irradiate a surface 31, realize, due to the contour variation of the object 30, a phase variation in the beam, which is related to that contour variation by the equation:

$$\Delta\phi = \frac{2\pi}{\lambda} \cdot 2d \cos\alpha \tag{1}$$

whereby $\Delta\phi$ is the phase variation relative to the zero phase (represented by the hatched line 38), $\lambda$ is the light wavelength used; $\alpha$ is the angle at which measurements are taken relative to a normal line, and d represents the contour variation.

Figure 7:
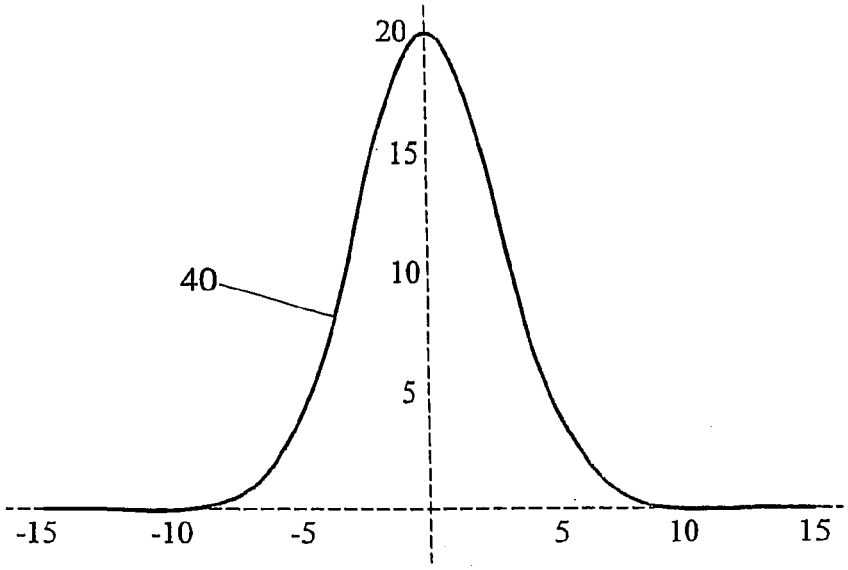
FIG. 7 shows a representation of a resolved phase according to the TPU-technique.

With reference to FIG. 7, it can now be understood how a similar phase pattern 39 (in this case of a symmetrical disturbance) is observed, if the reflected beam is combined with a zero phase beam. (This interference will be discussed further with reference to FIG. 11). As phase displacements, by nature, can only be observed modulo 2 $\pi$, without the use of the TPU technique, a phase image is formed having a large number of discontinuities on the 2 $\pi$-transitions. It will be clear that such transitions are very difficult to identify in practical measuring results, so that the "unwrapping" of a measured phase diagram 39 into a "real" phase image which corresponds to a phase variation resulting from a contour variation, for instance, as with reference to 38 represented in FIG. 5, is highly dependent on interference in the measured image and the number of phase jumps.

Figure 8:
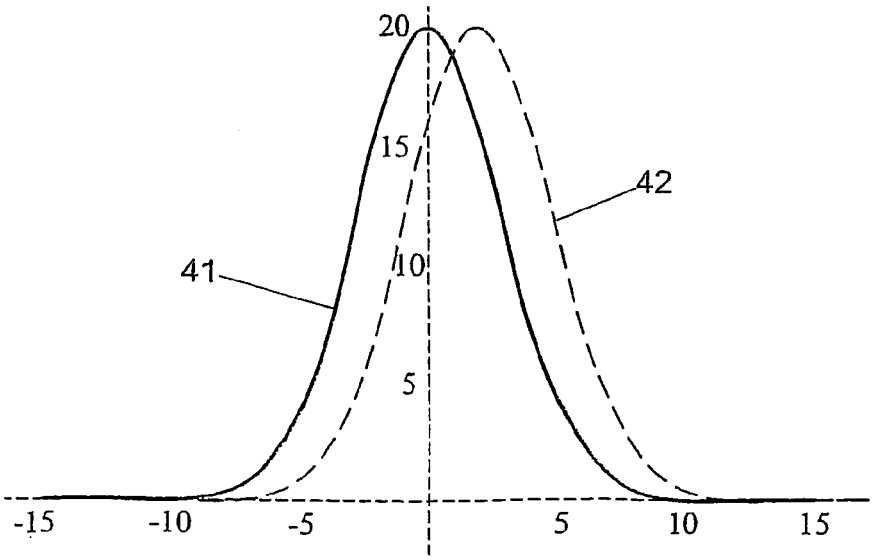
FIG. 8 shows a schematic representation of the phase images of two beams shifted slightly relative to each other.

FIG. 8 represents how such a phase image in "unwrapped condition" can be determined with the TPU technique. In essence, this technique amounts to limiting locally or temporally measured phase variations within a range of $2\pi$, so that, effectively, no phase jumps can occur. This can be achieved by having the changes in the surface between two measurements to be sufficiently small, through the measurements following each other rapidly, through the decrease proceeding sufficiently slow or through the applied change in the measuring system being sufficiently small.

As a result, by fixing a local or temporal phase variation with respect to a zero phase, a starting point can be chosen for measuring a next phase. In this manner, a phase image 40 remains resolved with time and place, without phase jumps occurring in the measurements. In the Figure, this amounts to scanning the contour in the direction of the arrow travelling along the phase plane, while, each time, a phase variation is determined lying within the range of 2 $\pi$. The detected phase variation is chosen as starting point for carrying out a next determination. The phase increase is added up for each position over time, so that the total of the phase variation remains inherently resolved.

An embodiment for calculating the phase changes can consist of registering at each moment phase-stepped images for calculating the phase, followed by subtracting the phase distribution for two consecutive images. For resolving the phase, therefore, minimally three phase-stepped images per instance need to be used: as three unknown quantities determine the phase-stepped images: the background intensity, the modulation intensity and the phase.

Another approach can be the combining of mutually split beams, while a second light beam is retarded relative to a first beam by a quarter wave length. The images thus obtained can, after for instance software-wise mirroring, be directly subtracted from each other to determine the change of the phase difference between the interfering beams of consecutive measurements.

For this approach, a minimum of four phase-stepped images is required:

Thus, for each time t the phase-stepped images are registered:

$$I_0(t)=I_B+I_M \cos(\phi(t)) \tag{2}$$

$$I_{\pi/2}(t)=I_B-I_M \sin(\phi(t)) \tag{3}$$

Here, $I_B$ and $I_M$ are the background and modulation intensity, respectively. The quantity $\phi(t)$ indicates the phase difference between the object and a reference phase. The phase change can be obtained between two successive takes t and t+T by $$\Delta\phi(t+T, t) = -\frac{\pi}{2} - 2\arctan\left(\frac{I_0(t) - I_{\pi/2}(t+T)}{I_{\pi/2}(t) - I_0(t+T)}\right) \tag{4}$$

whereby the subscript 0 and $\pi/2$ indicates the phase step between two interfering beams. The registered phase changes can be added via $$\Delta\Phi = \sum_i \Delta\phi(\{i+1\}T, iT)$$

Note that the phase represented in FIG. 7 has a range of 20, therefore virtually 7 $\pi$. It will be clear that this phase image cannot be directly observed but can only be calculated by means of resolving by, for instance, TPU.

Figure 9:
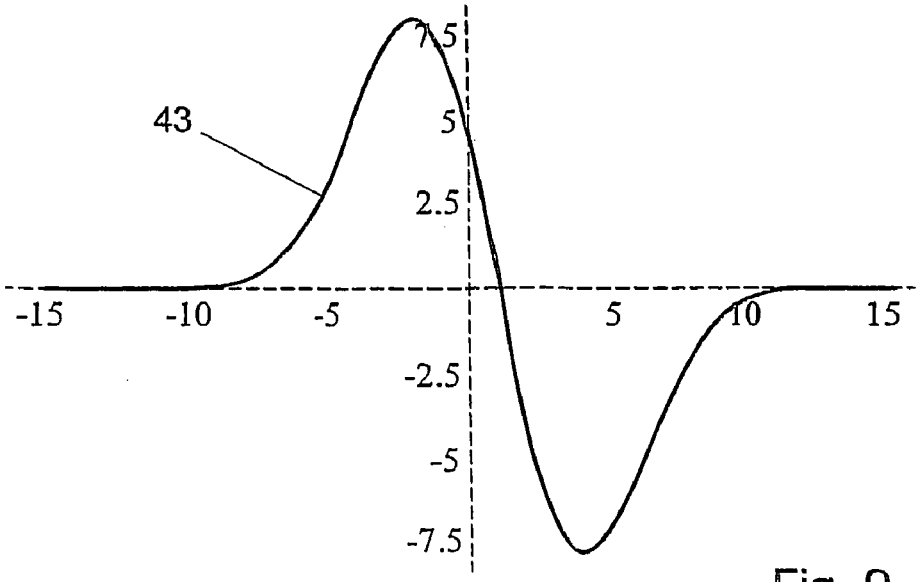
FIG. 9 shows a schematic representation of a combined phase image as can be derived from a fringe pattern.

In FIG. 8, an imaginary representation is shown of the phase pattern of a measuring beam, shifted slightly relative to itself, for instance with a contour variation 40 as represented in FIG. 7, represented by a continuous line 41 and a broken line 42. This technique is well known to the skilled person as shearing or shifting. Now, the beam is not combined with a zero phase beam, as is further elucidated with reference to FIG. 12, so that a contour as for instance the contour 40 in FIG. 7 can be obtained, but with a shifted version of the reflection beam. When these beams are combined, on a detection plane of for instance a camera a fringe pattern is observed representing the differential phase between the beams, as is the case with interference with a zero phase beam as described with reference to FIG. 7. The differential phase can be expressed as the mathematic derivative of the phase contour. By shifting the phase such that the differential phase is kept within a range of 2 π this differential phase can be resolved by means of TPU, which results in a phase contour 43 as represented with reference to FIG. 9. It is true that the positive left hand part of the phase contour of FIG. 9 represents the part where the continuous line 41 of FIG. 8 runs above the interrupted line 42 of the shifted beam; the negative part gives the right hand part where the continuous line 41 runs below the interrupted line 42. To obtain the real phase contour, as it runs as the continuous line 41 or interrupted line 42 of FIG. 8, the phase obtained by means of TPU has to be integrated in the direction of the shearing. If the invention is used in a material-adding or material-removing operation, i.e. in the case a contour varies locally, it is advantageous to start the integration from a zone in which no changes have occurred; this zone then serves as reference zone and contour variations can unequivocally be determined on such a fixed reference. If such a reference zone is not available, the variation can only locally be identified and the contour is determined except for one constant. The degree of shearing is determined by the slope of the contour variation; if a considerable slope is detected, the shearing has to be relatively limited for unambiguously resolving the phase, conversely, if a relatively small slope is detected, the shearing can be considerable. By adjusting the shearing to a detected slope, each time, with a maximum resolution, an incremental phase variation can de detected, so that the method has a relatively large sensitivity.

Figure 10:
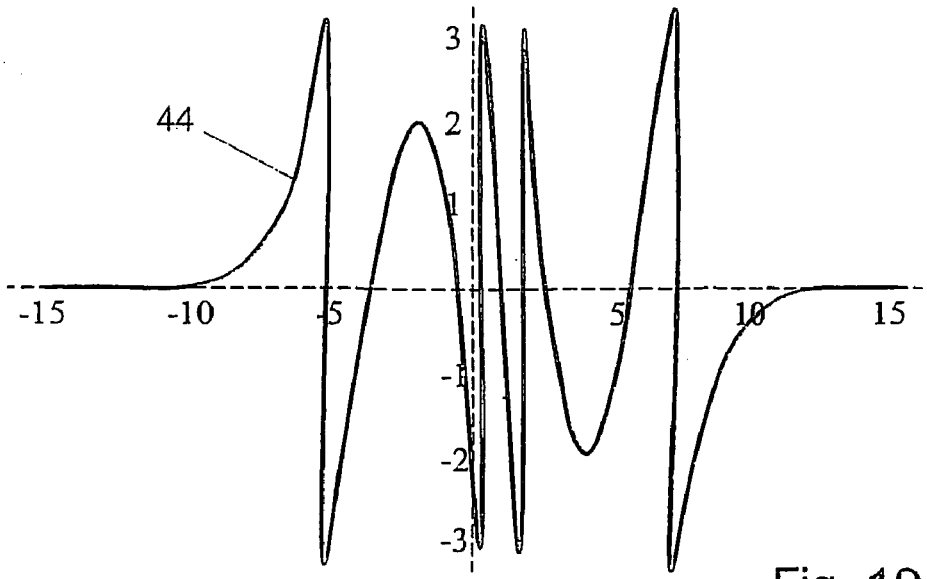
FIG. 10 shows a schematic representation of the phase image without the phase being resolved over time.

Finally, FIG. 10 demonstrates a differential phase image 44 as it is measured without keeping the phase resolved with time, i.e. if phase changes greater than 2 pi occur. It is clear, in particular for practical set-ups which are subject to inherent system inaccuracies and interferences, that such dimensions are difficultly reducible to a phase diagram are represented in FIG. 8.

Figure 11:
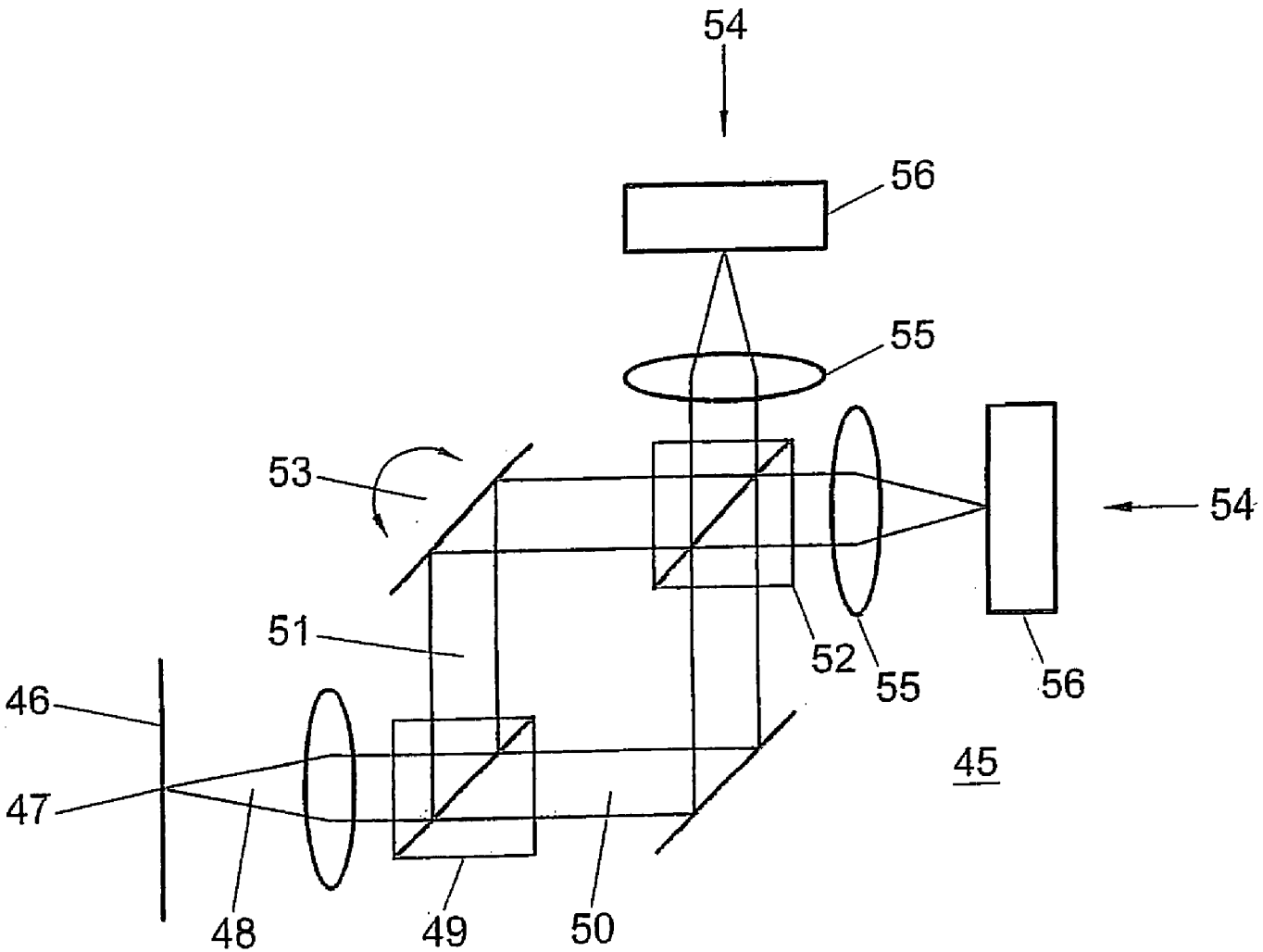
FIG. 11 shows a first set-up according to the invention for measuring a contour variation.

FIG. 11 shows a first set-up of an apparatus according to the invention, wherein use is made of a device for measuring a contour variation of a measuring area on an object. The device 45 of FIG. 11 comprises a light source (not represented) irradiating a measuring area 46, while from a position 47 a reflection beam 48 is generated. The measuring area is schematically represented and forms part of a contour of an object, which is positioned by a holder (not shown) relative to the light source and the measuring optic 45. The measuring optic comprises a semi-transparent mirror 49 disposed at an angle, for splitting the reflected beam 48. Therefore, the mirror 49 generates two mutually split beams 50 and 51, perpendicular to each other. The beams 50 and 51 travel a separate optical path through the measuring optic 45 before they are combined in a second semi-transparent mirror 52. Due to a rotatable mirror 53, the mutual angle of beam 51 is adjustable relative to the mirror 52. As a result, beam 51 is projected on mirror 52 at an angle displaced as a result of rotation. The semi-transparent mirror 52 projects the beam in two branches 54, each provided with a lens 55 and a camera 56. By means of phase members (not shown), the branches are retarded relative to each other so that, as is explained hereinabove with reference to equations 2)–3), two phase stepped images are observed which are rotated in phase 90° relative to each other. The cameras 56 are both connected to a processor (not shown) which by subtracting both images can directly determine a phase increment according to equation 3). As beam 51 is projected on the lenses 55 as a result of the angular displacement, a camera 56 arranged in the focal plane of the lens 55 observes a fringe pattern resulting from a shift of the beams 50, 51, which corresponds to the angular displacement of the rotating mirror. Thereupon, the processor calculates from equation 1 an optic path length difference and for relating the optic path length difference to the contour variation of the object.

Figure 12:
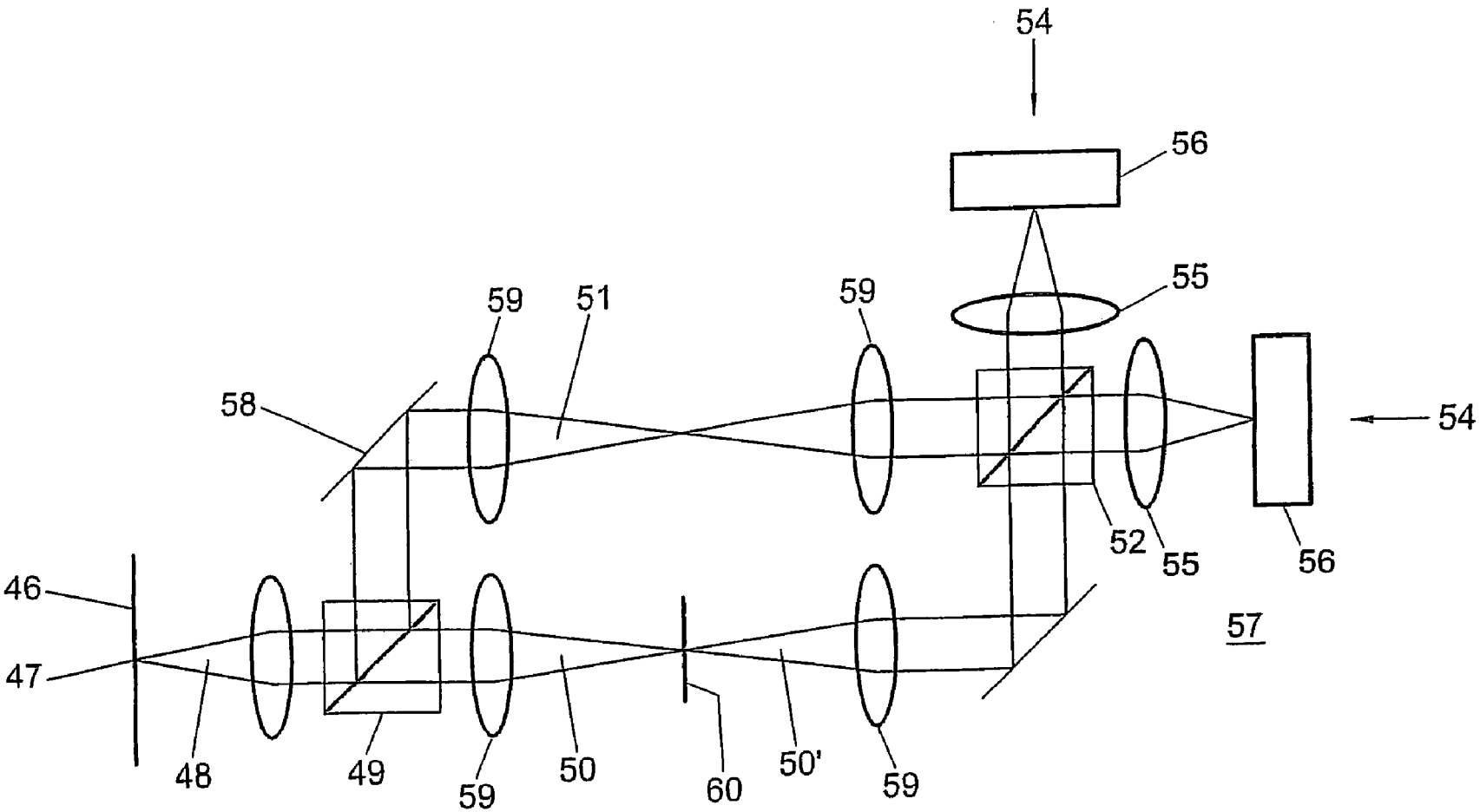
FIG. 12 shows a second set-up according to the invention for measuring a contour variation.

FIG. 12 shows a second set-up according to the invention, wherein use is also made of a device for measuring a contour variation of a measuring area on an object. As is represented in FIG. 11, the device 57 of FIG. 12 comprises a light source (not shown) irradiating a measuring area 46 while a reflection beam 48 is generated.

Figure 6:
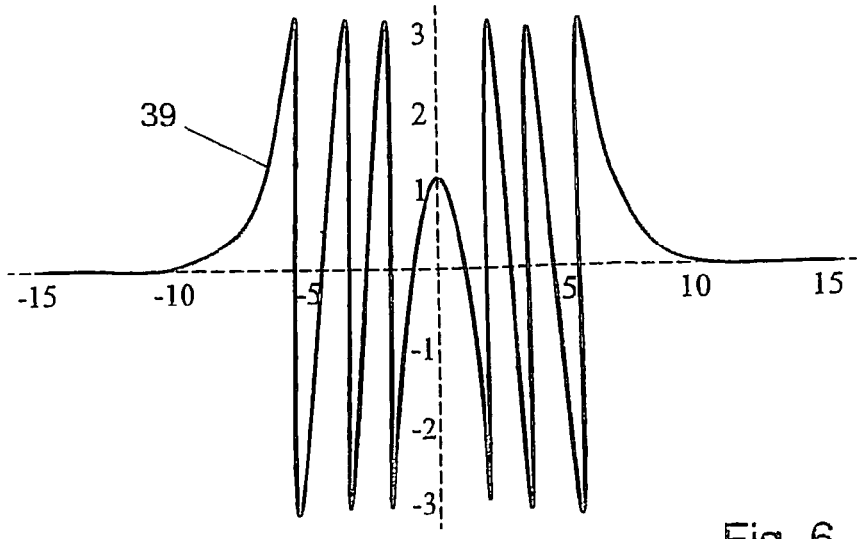
FIG. 6 shows a representation of a phase image as can be derived from a fringe pattern.

As in the set-up of FIG. 11, the measuring optic 57 comprises a semi-transparent mirror 49 disposed at an angle, for splitting the reflected beam 48. Therefore, the mirror 49 generates two mutually split beams 50 and 51 perpendicular to each other. The beams 50 and 51 travel a separate optical path through the measuring optic 57, before they are combined in a second semi-transparent mirror 52. However, the rotatable mirror 53 of FIG. 11 is now replaced by a stationary mirror 58, which has the split beam 51 run parallel to the continuous beam 50. The split beam is projected directly onto the semi-transparent mirror 52, which projects the beam in two branches 54, each of which is also provided with a lens 55 and a camera 56. The branches are further designed as set forth with reference to FIG. 11. Instead of, as was the case with FIG. 11, combining the beam with a shifted version of itself, now, in one of the split beams 50, an optical phase-filter is disposed. This phase filter comprises a pinhole 60 arranged between two lenses 59 which only allows a small fraction of the beam to pass. As a result, a point-shaped light source is simulated with a virtually flat phase front. Therefore, by this phase front, a zero phase beam is given off, further carrying in itself exactly the disturbances and path length differences which are introduced by the optic in the split version. To increase the symmetry, in the split beam 51 an identical lens arrangement 59 can also be disposed. By combining the zero phase beam 50' and the split beam 51, a fringe image is created from which, as is set forth with reference to FIGS. 6 and 7, a phase variation can be derived which can be related to the contour variation of the measuring area 46.

Although the invention has been discussed with reference to the exemplary embodiments represented in the drawing, it is not limited thereto but can comprise all sorts of variations and modifications thereof. For instance, it is very well possible, in contrast to the exemplary embodiments described, to analyse a transmission beam in optical transmissive objects. This can even be an advantage if the upper side of the object is difficulty accessible, for instance, as a material-adding or material-removing operation is carried out. Further, the phase variation can be analysed with the aid of diffuse light beams, because the technique only utilizes a differential phase measurement. The real phase may therefore yield an image which is "wild" and difficult to analyse, as long as the differential images possess sufficient resolution. By utilizing diffuse light beams, for instance, by irradiating an object to be analysed with a diffuse beam or by irradiating it with a relatively coherent beam, but whereby the object is provided with a mat layer, at a relatively limited observation angle, a phase image and associated phase variation can be observed carrying information in it about a relatively large surface with relatively great contour variations. These diffusion beam techniques or speckle techniques therefore appear to be very favorable for the analysis of relatively large measuring areas with relatively great contour variations.

Further, the discussed technique according to the exemplary embodiments is placed in a context of surfaces which, by means of material-adding or material-removing operations, change form. However, the method and apparatus are also suitable for scanning surfaces which do not change form, but where a phase variation occurs only by contour variation resulting from a scanning movement of the measuring beam relative to a measuring area.

Such variations are understood to fall within the reach of the invention as outlined by the following claims.

The invention claimed is:

1. A method for machining a workpiece surface, wherein an area to be machined of the workpiece surface, under the influence of a polishing operation, is machined and wherein, during machining, the displacement of the area to be machined relative to a reference area rigidly coupled to the workpiece surface is monitored by following, over time, a phase difference between a measuring beam and a reference beam and converting it to a displacement relative to the reference area, characterized in that by selecting the change of the phase difference between measurements in the interval ($-\pi$, $\pi$), the total displacement can be obtained by adding.

2. A method according to claim 1, wherein, for the purpose of the interferometry of two mutually coherent light beams, a first light beam is reflected on the area to be machined and a second light beam is reflected on the reference area.

3. A method according to claim 1, characterized in that the phase variation is detected by means of shearing the beam.

4. A method according to claim 1, wherein, after reflection, the beams are combined and wherein the phase difference between the interfering beams is measured and wherein from consecutive measurements the change of the phase difference between the interfering beams of the successive measurements, the displacement of the area to be machined relative to the reference area is determined and wherein the displacements of the area to be machined, determined between two consecutive measurements, relative to the reference area are added up.

5. A method according to claim 4, wherein the time interval between consecutive measurements is chosen such that the change of the phase difference between the interfering beams lies between $-\pi$ and $\pi$.

6. A method according to claim 1, wherein the polishing operation is carried out by determining, on the basis of a desired geometry and a measured geometry determined prior to the polishing operation, a differential geometry for the workpiece surface, and wherein on the workpiece surface on the basis of the differential geometry, a number of machining volumes are defined and wherein the machining volumes are machined under the influence of the polishing operation with an area to be machined and wherein, each time, the machining is stopped when it has been established through monitoring that the displacement of the area to be machined substantially corresponds to the displacement required for the removal of the machining volume.

7. A method according to claim 1, wherein the workpiece surface, at least near the area to be machined, prior to the measurement, is cleared of contaminations which may cause false reflections.

8. A method according to claim 1, wherein the reference area forms part of the workpiece surface.

9. A method according to claim 1, wherein the workpiece is transparent and wherein at least the first light beam is reflected through the workpiece on the side of the area to be worked adjoining the workpiece.

10. A method according to claim 9, wherein at least one of the beams is guided to the side of the workpiece surface adjoining the workpiece via a fluid, adjoining the workpiece surface and which has a refractive index which is substantially equal to the workpiece material.

11. A method according to claim 9, wherein at least the first light beam enters at the side of the area to be machined adjoining the workpiece at an angle which is greater than the critical angle for total internal reflection.

12. A workpiece, provided with a workpiece surface which is polished with the aid of a method according to claim 1.

13. A measuring tool comprising:

a light source for providing a light beam for irradiating a measuring area;

a holder for positioning a workpiece relative to the light source;

characterized in that said measuring tool further comprises:

a beam splitting member for splitting the transmitted or reflected beam;

a phase influencing member for setting a phase difference between the split beams;

a beam combining member for combining the split beams;

an observation member for observing a fringe pattern indicating a differential phase between the split beams; and a processor for calculating an optical path length difference from the differential phase and for relating the optical path length difference to the contour variation of the object.

14. A measuring tool according to claim 13, wherein the phase influencing member comprises an optical phase filter for generating a predetermined phase plane.

15. A measuring tool according to claim 14, characterized in that the phase filter is a pin hole, so that the phase plane is a zero front.

16. A measuring tool according to claim 13, characterized in that the phase influencing member comprises a rotating mirror for displacing the split beam at an angle, wherein the beam combining member combines the split beams and projects them, mutually running at an angle on a lens, wherein the observation member is arranged in a focal plane of the lens, so that a fringe pattern is observed resulting from a shifting of the beams corresponding to the angular displacement of the rotating mirror.

17. A machining apparatus, comprising a polishing tool and a measuring tool according to claim 13.

18. A machining apparatus according to claim 17, wherein the measuring tool is provided with means for giving off first and second coherent light beams and wherein at least the means for giving off the first coherent light beam are arranged so as to be translatable and/or rotatable relative to said holder.

19. A machining apparatus according to claim 17, wherein the measuring tool is rigidly connected to a clamping device in which a workpiece can be included.

20. A machining apparatus according to claim 19, wherein the clamping device is provided with a fluid container for containing a transparent fluid.

21. A machining apparatus according to claim 17, wherein means are provided for measuring the roughness of the workpiece surface.

22. A machining apparatus for machining a workpiece surface, comprising means for machining the workpiece surface under the influence of a polishing operation, and means for monitoring, during machining, the displacement of the area to be machined relative to a reference area rigidly coupled to the workpiece surface, by following, over time, a phase difference between a measuring beam and a reference beam and converting it to a displacement relative to the reference area, and means whereby, by selecting the change of the phase difference between measurements and the interval ($-\pi$ and $\pi$), the total displacement can be obtained by adding.

* * * * *